United States Patent [19]

Chamberlain

[11] 4,329,654

[45] May 11, 1982

[54] PARTICLE ACCELERATOR

[75] Inventor: Jerry E. Chamberlain, Pittsburg, Calif.

[73] Assignee: Siemens Medical Laboratories, Inc., Walnut Creek, Calif.

[21] Appl. No.: 141,111

[22] Filed: Apr. 17, 1980

[51] Int. Cl.[3] ..... H05H 9/00

[52] U.S. Cl. ..... 328/233; 307/353; 313/359.1; 328/151

[58] Field of Search ..... 313/359, 363; 328/227, 328/228, 233–238

[56] References Cited

U.S. PATENT DOCUMENTS 2,887,580 5/1959 Bischoff .

3,412,337 11/1968 Lothrop ..... 328/228

3,965,434 6/1976 Helgesson ..... 328/233

*Primary Examiner*—Paul L. Gensler

*Attorney, Agent, or Firm*—Spellman, Joel and Pelton

[57] ABSTRACT

The particle accelerator contains an accelerator guide for accelerating particles, an injector for injecting particles into the accelerator guide, a pulsed source of high frequency power which has power adjusting means, a device for introducing the high frequency power from the source into the accelerator guide, a measuring device for measuring particle pulses emitted from the accelerator guide, and a power control circuit connected to the power adjusting means. The power control circuit includes a circuit for supplying an adjusting signal in dependence on the deviation of each particle pulse from an optimum pulse form and a connecting circuitry for connecting the adjusting signal to the power adjusting means. By changing the high frequency power of the source, the form of the measured particle pulses is adjusted towards the optimum pulse form.

12 Claims, 11 Drawing Figures

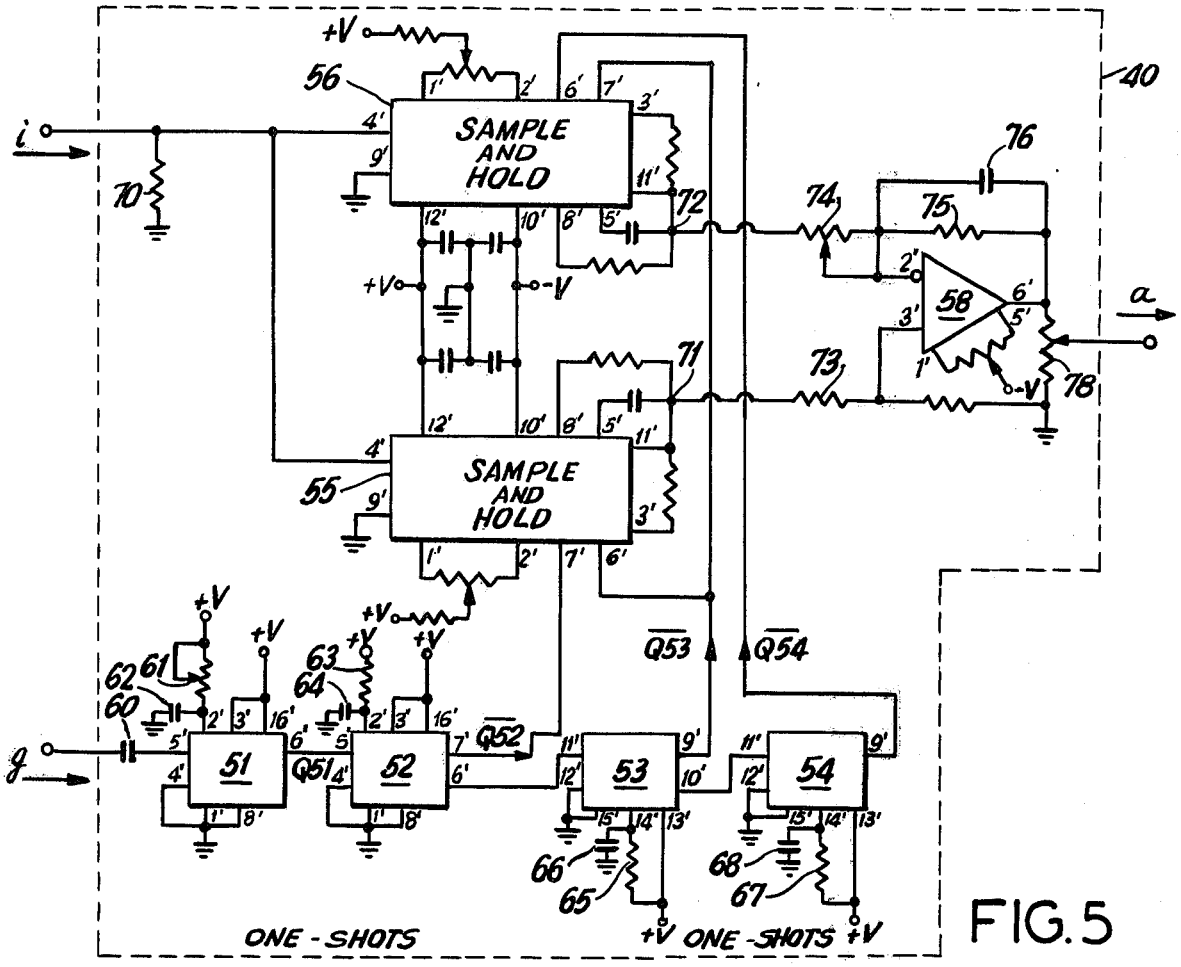
FIG. 5
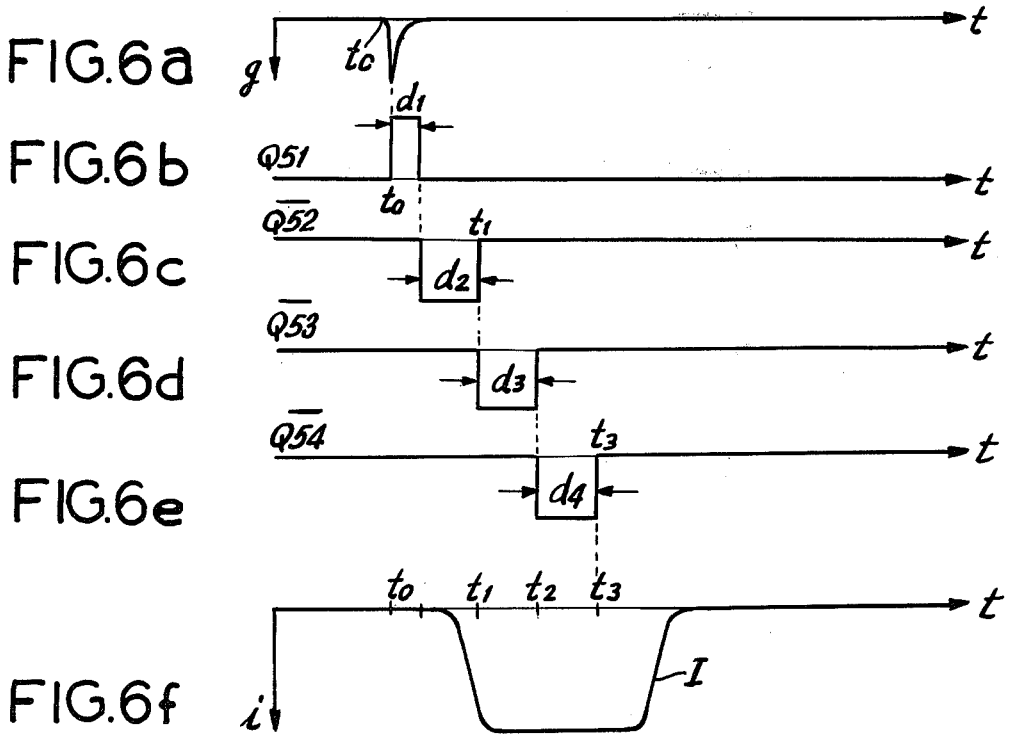

PARTICLE ACCELERATOR

BACKGROUND OF THE INVENTION

1. Field of the Invention

This invention relates to a particle accelerator. More particularly, this invention relates to a particle accelerator having an accelerator guide, a particle source for injecting particles into the accelerator guide, a source of high frequency energy, a coupling element for introducing high frequency energy from the source of high frequency into the accelerator guide for energy exchange with and acceleration of the particles, and a delivery end for delivering pulses of particles. Still more particularly, this invention relates to an automatic control system for driving a particle accelerator, preferably a linear accelerator.

A linear accelerator of the type here contemplated is adapted to receive electrons at relatively low velocity, to accelerate the received electrons to high energy levels, and either to deliver the accelerated electrons as high velocity electrons or to direct them onto a target to generate X-rays.

2. Description of the Prior Art

Particle accelerators such as linear accelerators are used today in a number of different applications such as radio therapy, radiography and sterilization. In most of these applications the particle accelerator is used to generate X-rays.

It is very important that a constant dose rate output from the accelerator be achieved over both a short period of time, such as during a specific therapy treatment, as well as a long period of time such as day to day during successive treatments. It is also very important that the accelerator deliver electrons at uniform energy and power levels at each selected setting of the controls, which are associated with the particle source and the source of high frequency energy.

One of the leading causes of possible variation in the output from an accelerator is the change in particle output amplitude resulting from a mismatch between the operating frequency of the accelerator and the frequency of the driving signal applied thereto. This mismatch can result from dimensional changes in the accelerator structure or differential expansion in different parts of the accelerator structure thereby resulting in a change in its operational frequency.

According to U.S. Pat. No. 3,965,434, the desired relationship between the driving frequency source and the accelerator can be maintained by an automatic frequency control which tunes the frequency of the accelerator driver source to the operational frequency of the accelerator. The particle output amplitude from the accelerator is measured by a signal derived from an ionization chamber wherein current pulses are sampled to obtain an output signal representative of modulated particle (X-ray) pulses. This signal is amplified and applied through the automatic frequency control aspect of the system to a stepping pulse generator wherein a signal is added to minimize power modulation effects of the accelerator RF source and synchronously demodulated to produce a frequency error voltage and stepping pulses having rates which are proportional to this error voltage. The stepping pulses are directed to the drive of a stepping motor to step the tuner of the driver source to the point where the particle output amplitude is maximized. The automatic frequency control does not compensate for energy deviations due to the shift of components.

In U.S. Pat. No. 2,887,580, there is disclosed another variable output control for a linear accelerator. In this control, a pulsed radio frequency power supply system is employed to introduce energy into a wave guide. The frequency is controlled by a frequency adjusting circuit, and the output energy of the wave guide is continuously measured or monitored. A mixing circuit operates to combine a control impulse corresponding with the frequency of the measured output energy level with an impulse corresponding with the frequency variation of the power supply. The resultant impulse is then applied to the frequency adjusting circuit to correspondingly correct the frequency of wave guide input energy, while the pulse rate is simultaneously adjusted in response to monitored changes in the wave guide output power in order to maintain output power at a desired level. Despite this output control, the form of the output pulses may change due to a drift of the components of the circuit.

SUMMARY OF THE INVENTION

1. Objects

It is an object of the invention to provide a controlled particle accelerator that emits particle pulses at widely uniform energy at each selected setting of the controls.

It is another object of the invention to provide a particle accelerator with an automatic energy control of quick response.

It is still another object of the invention to provide a controlled linear accelerator that emits electron pulses of widely uniform energy at each selected setting of the controls.

It is still another object of the invention to provide an automatic high frequency power control circuit for driving a linear accelerator.

It is still another object of the invention to provide such an automatic HF power control circuit that optimizes continuously the power of the HF energy wave supplied to the linear accelerator thus producing the maximum particle output from the accelerator.

It is still another object of the invention to provide a HF energy control circuit that works together with an automatic power control for maintaining the frequency of an electron linear accelerator matched to the optimal electron energy.

It is still another object of the invention to provide a control circuit which is applicable in an accelerator having a pulse measuring device which developes U-shaped or negative square-wave pulses.

Still other objects will become apparent in the course of the following description.

2. Summary

According to this invention, a particle accelerator incorporates an accelerator guide for accelerating particles, this guide having a particle input for receiving particles and a particle output for emitting pulses of high energy particles, a particle injector for injecting particles into the particle input of the guide, a pulsed source of high frequency power, the source having a power adjusting device for changing the high frequency power, a device for introducing the high frequency power from the source into the guide for energy exchange with and acceleration of the particles to obtain the mentioned high energy particle pulses at the output of the accelerator guide, a measuring device for measuring the particle pulses emitted from the particle output, a power control circuit connected to the power adjusting device for changing the high frequency power of the source, this power control circuit including means for supplying an adjusting signal in dependence of the deviation of each particle pulse form from an optimum pulse form, wherein the signal supplying means is connected to the measuring device, and means for connecting the adjusting signal to the power adjusting device to change the high frequency power of the source, thereby adjusting the form of the measured particle pulses to the optimum pulse form.

The foregoing and other objects, features and advantages of the invention will be apparent from the following more particular description of the preferred embodiment of the invention, as illustrated in the accompanying drawings.

BRIEF DESCRIPTION OF THE DRAWINGS

In the drawings:

FIG. 5 is a diagram of a preferred HF power control circuit which can be used in the accelerator of FIG. 1; and FIGS. *6a–6f* are time diagrams illustrating the function of the control circuit shown in FIG. 5.

DESCRIPTION OF THE PREFERRED EMBODIMENT

Figure 1:
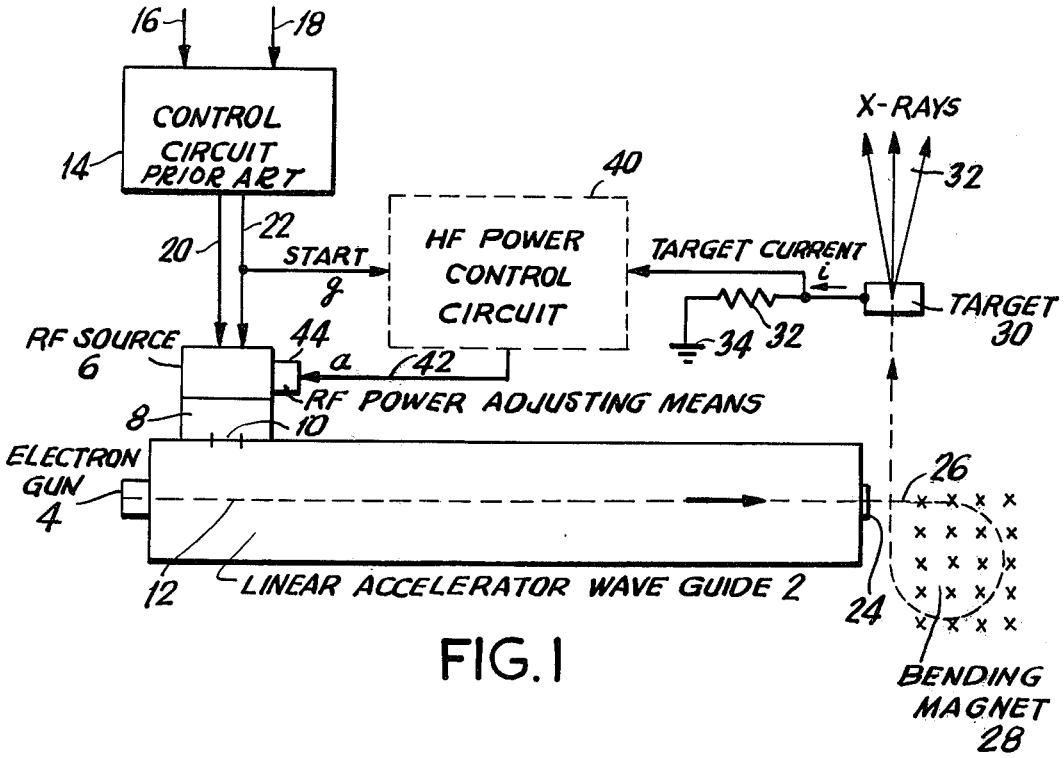
FIG. 1 is a view of an electron linear accelerator having a HF power control circuit in order to control the electron energy distribution of the emitted high energy pulses.

With reference to FIG. 1, a linear accelerator for medical treatment is shown having a conventional accelerator chamber or wave guide 2 and a particle source 4. The wave guide 2 is determined for accelerating negatively charged particles, i.e. for accelerating electrons. The particle source 4, which is referred to as an electron gun, is provided for emitting and injecting electrons into the injecting end of the wave guide 2.

The wave guide 2 may consist of a hollow tube into which is introducted an electromagnetic wave from a suitable radio frequency (RF) or high frequency (HF) source 6 via a coupling or introducing element 8 and an HF input window 10. Instead of a socalled travelling wave guide, a standing wave guide can be used. For instance, a wave guide 2 of the known type "Los Alamos" can be employed. The wave guide 2 may have approximately a cylindrical shape and a linear main axis 12. The interior of the wave guide 2 is evacuated.

The HF source 6 is controlled by a control circuit 14. The circuit 14 is part of a closed loop circuit. Two input signal lines are designated as 16 and 18. The control circuit 14 controls the RF source 6 in a way as to generate electron pulses of high energy at the delivery end of the wave guide 2. The control circuit 14 selects the frequency and the desired pulse rate of the RF source 6. The frequency control signal is transmitted via an output line 20, and the pulses may be started by a start signal g via an output line 22. The control circuit 14 is of conventional character.

Electrons introduced into the wave guide 2 are accelerated along the central axis 12. They will obtain a high energy by virtue of the electromagnetic waves provided inside the wave guide 2. A pulsed beam of electrons is emitted from an electron exit window 24, which is located at the delivery end of the wave guide 2. The exit window 24 conventionally consists of a thin metal foil.

The accelerated electrons have a high energy, for instance, 4 MeV. They leave the wave guide 2 through the exit window 24 as an output beam 26. The output beam 26 is directed to a magnetic bending system 28, which acts as an energy filter. The beam 28 is bent by about 270°. It is then directed onto a target 30 to generate pulses of X-rays 32. In usual medical applications, either the output beam 26 of high energy electrons or the X-rays from the target 30 are employed for radiation treatment of a patient.

As indicated in FIG. 1, the target 30 is used to generate X-rays 32. The target 30 is part of a measuring device which measures current pulses of the high energy electrons as target current i. The measuring device is a resistor 32 which is connected between the target 30 and ground 34. The voltage derived from the resistor 32 is dependent on the target current i.

As mentioned above, the linear accelerator is operated in a pulsed mode. If the operation is optimized, the electron beam current and also the target current i will consist of a series of pulses, one of which is shown as wave form I in FIG. 2. Wave form I is a symmetric wave form having a long, flat middle portion and two short, steep side portions. Such a wave form I can be considered to be of U-shape rather than of V-shape. The total duration of such a pulse typically may be, for instance, 2 microseconds, and the flat middle portion may last, for instance, about 1.8 microseconds.

Assume now that the operation of the linear accelerator is no longer optimized. If the power of the RF source 6 has become too high (so that a lower HF power is required), the signal has changed and the pulses in the target current i attain the form of wave form II in FIG. 3. The middle portion of the pulses is no longer flat. It now shows a "recess," the relative magnitude of which depends on the degree of deviation from the optimal operation.

Figure 3:
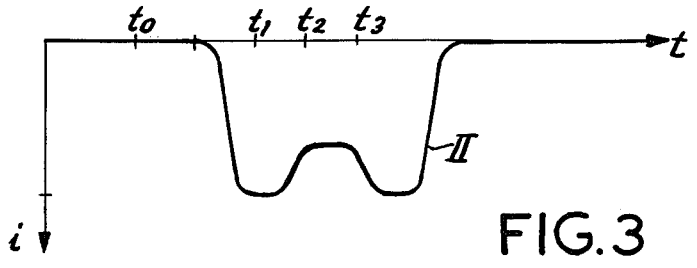
FIG. 3 is a diagram showing a pulse with a recess-type deviation from the optimum wave form.
Figure 4:
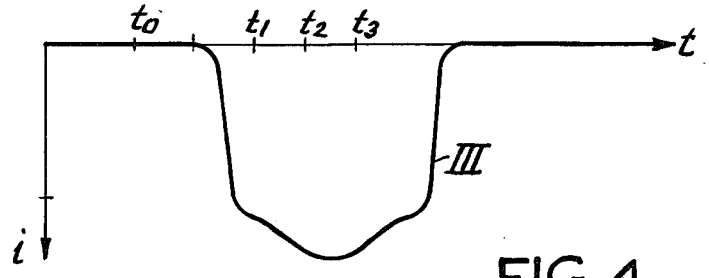
FIG. 4 is a diagram showing a pulse with a bump-type deviation of the optimum wave form.

If, on the other hand, the HF power of the HF source 6 has become too low (and increased HF power is required), the beam current pulses attain a wave form shown as wave form III in FIG. 4. Now the middle portion of the pulse is extended in the other or more negative direction than the shape shown in FIG. 3. The pulse shows a "bump."

The change of the wave form (see II and III in FIGS. 3 and 4) of the output pulses from an optimized wave form (see I in FIG. 2) occurs when the electron energy changes. The energy of the emitted electrons may change due to a drift in the components (for instance, electrical components of the control circuit 14, mechanical extensions of wave guide 2 under the influence of temperature) of the linear accelerator. Such an energy change cannot be controlled by the usual known control circuit 14.

In order to maintain an optimized output beam current, that is to maintain an optimized electron energy and an optimized wave form I (see FIG. 2), an HF power control circuit 40 is provided.

The HF power control circuit 40 supplies an adjusting signal a in dependence of the deviation of each electron pulse form (see form II or III in FIGS. 3 and 4, respectively) from an optimum pulse form (see form I in FIG. 1). A deviation determining circuit is provided that investigates the middle portion of each pulse in order to determine whether it is flat (FIG. 2), has a "recess" (FIG. 3) or a "bump" (FIG. 4). In order to make such a determination, the HF power control circuit 40 is connected to the pulse measuring device 30, 32 for receiving the voltage drop of the resistor 32, and to the output line 22 for receiving the start signal g or trigger signal indicating the beginning (time $t_0$) of the pulses. The adjusting signal a of the control circuit 40 is connected via a connection line 42 to a power adjusting device 44 associated with the HF source 6. The adjusting device 44 is provided for changing the HF power of the source 6.

An HF power source 6 of any suitable, conventional character can be used having power varying means 44 of any known character preferably for continuously varying the power delivered by the source 6. It may be sufficient to vary the HF power over a limited range. A known HF source 6 such as a klystron has an adjusting device 44 that can be controlled by a signal a which is a dc signal. Particularly, the adjusting device 44 of a klystron may be its current control input.

Thus, it will be understood that the HF power control circuit 40 forms a closed loop control circuit which senses deviations from the normal wave form (wave form I) and corrects the HF power accordingly.

Figure 2:
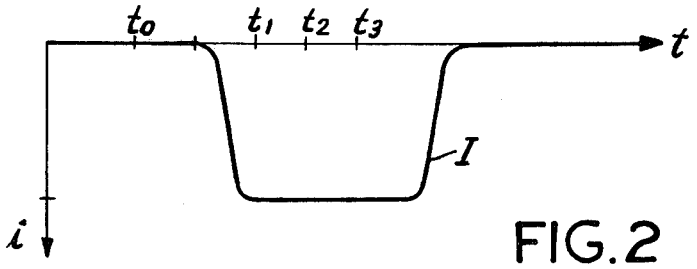
FIG. 2 is a diagram showing an U-shaped pulse representing the optimum wave form of the high energy pulses.

In FIGS. 2, 3 and 4, time $t_0$ marks the "start" of the linear accelerator by a trigger signal and therefore the beginning of a pulse. Time $t_1$ marks the beginning of the flat portion of the signal I and the beginning of the "ground level" in the signals II and III. Times $t_2$ and $t_3$ indicate points of time prior and after the middle of the current pulse, respectively.

The HF power control circuit 40 is such that it derives or develops a reference signal $r(t_2)$ at the time $t_2$ (which signal should be at least fairly constant), stores it a short while and compares it with the actual value $s(t_3)$ of the current pulse at the time $t_3$. The adjusting signal a is derived in dependence of such comparison. If $|r(t_2)|$ is larger than $|s(t_3)|$, then the electron energy (see wave form II) is excessive, and the adjusting signal a will lower the HF power. If, however, $|r(t_2)|$ is smaller than $|s(t_3)|$, then the electron energy (see wave form III) is insufficient and the adjusting signal a will increase the HF power.

This principle can be advantageously applied to a linear accelerator which generates X-rays on a target. It may also be advantageously applied to an accelerator having a beam current measuring device in the form of a target current measuring device. An ionization chamber (which also is able to measure the beam current) delivers output pulses with another shape than shown as wave form I in FIG. 2. These pulses have rather a V-shape than a U-shape, and it is more difficult to determine the "ground level."

In FIG. 5 a preferred embodiment of the HF power control circuit 40 is shown. The control circuit 40 contains four monostable multivibrators or one-shot circuits 51, 52, 53 and 54, two sample-and-hold circuits 55 and 56, and a differential amplifier or comparator 58. The one-shot circuits 51, 52, 53 and 54, the sample-and-hold circuits 55 and 56, and the differential amplifier 58 may be of any well known and conventional design. In a control circuit 40, which has been tested, specific elements were as follows: each of the sets of two one-shot circuits 51, 53 and 52, 54 was a dual monostable multivibrator type 4528 of "Motorola," each of the sample-and-hold circuits 55 and 56 was a high speed sample-and-hold amplifier with reset type LH 0053C of "National Semiconductors," and the differential amplifier 58 was an operational amplifier type LM 741 of "National Semiconductors." The pin numbers at the components 51 through 58 in FIG. 5 refer to these specific elements, and the operation of the control circuit 40 will be described below on the basis of these specific elements. It is, however, understood that the invention is not limited to the application of these specific elements.

The trigger signal g which turns on the RF at a point of time $t_0$ (sometimes called beam modulator trigger signal), is fed through a coupling capacitor 60 to the first one-shot circuit 51. The one-shot circuit 51 contains an RC circuit consisting of a potentiometer 61 and a capacitor 62. The potentiometer 61 is connected to a voltage source having a voltage $+V$, and the capacitor 62 is grounded. The RC circuit 61, 62 is an adjustable delay element having an adjustable delay time $d_1$. The delay time $d_1$ can be adjusted by means of the potentiometer 61, for instance, to a fixed value between 0 and 10 microseconds. The delay time $d_1$ is set to a value $d_1=(t_1-t_0)-d_2$, wherein $d_2$ is the delay time of the following one-shot circuit 52, so that the point of time $t_1$ approximately coincides with the beginning of the base level of wave form I (see FIG. 6).

The output 6' of the first one-shot circuit 51 is connected to the input 5' of the second one-shot circuit 52. Thus, circuit 52 is triggered by circuit 51. The second one-shot circuit 52 has basically the same design as the first one-shot circuit 51. It contains an RC circuit consisting of a resistor 63 having a fixed value and of a capacitor 64. The resistor 63 is connected to a voltage source having the voltage V, and the capacitor 64 is grounded. The RC circuit 63, 64 is a delay element having a fixed delay time $d_2$ of, for instance, $\frac{2}{3}$ microseconds.

The second one-shot circuit 52 supplies two output signals on its outputs 6' and 7'. These output signals are inverse to each other. The output 6' is connected to the input 11' of the third one-shot circuit 53, and the output 7' is connected to the reset input 7' of the first sample-and-hold circuit 55. Therefore, the output signals of the second one-shot circuit 52 determine the start of the third one-shot circuit 53 and the reset time of the first sample-and-hold circuit 55, respectively.

The third one-shot circuit 53 contains also an RC circuit, which is provided by a resistor 65 of a fixed value and a capacitor 66 and which represents a delay element. The delay time $d_3$ of this delay element 65, 66 may arbitrarily be chosen to equal the delay time $d_2$. It may be, therefore, for instance $\frac{2}{3}$ microseconds. The third one-shot circuit 53 has two outputs 9' and 10' which deliver output signals that are inverse to each other. The output 9' is connected to the start input 6' of the first sample-and-hold circuit 55 and also to the reset input 7' of the second sample-and-hold circuit 56. The output 10' is connected to the input 11' of the fourth one-shot circuit 54.

The fourth one-shot circuit 54 contains also an RC circuit. This RC circuit is a delay element having a fixed delay time $d_4$. The delay element consists of a resistor 67 and a capacitor 68. The delay time $d_4$ should be chosen to equal the delay time $d_3$. Therefore, it may also be $\frac{2}{3}$ microseconds. The output 9' of the fourth one-shot circuit 54 is connected to the start input 6' of the second sample-and-hold circuit 56.

The beam current signal i is supplied via a grounded input resistor 70 to the inputs 4' of the first and the second sample-and-hold circuit 55 and 56, respectively. As long as these circuits 55 and 56 are triggered by signals on their inputs 6', they will sample information.

The outputs of the sample-and-hold circuits 55 and 56 are designated 71 and 72, respectively. They are connected via input resistors 73 and 74, respectively, to the inputs 3' and 2', respectively, of the comparator 58. Input 2' is an inverting input, and input 3' is a non-inverting input. The comparator 58 contains a smoothing circuit, represented by a feed back circuit having a resistor 75 in parallel to a capacitor 76. At an output potentiometer 78 of the comparator 58, an output signal is supplied which is used as adjusting signal a to adjust the HF power of the HF source 6.

As mentioned above, the delay times $d_2$, $d_3$ and $d_4$ may be chosen to have the same value. However, the delay time $d_2$ can also be different from the delay times $d_3$ and $d_4$. There may also be a gap between the first sampling period, which corresponds to the delay time $d_3$, and the second sampling period, which corresponds to the delay time $d_4$.

Turning now to FIG. 6, the operation of the control circuit 40 in FIG. 5 will be described. When the modulator trigger signal g exhibits a pulse at the point of time $t_0$ (see FIG. 6*a*), the first one-shot circuit 51 delivers a pulse at its output 6' of adjustable, but predetermined length $d_1$ (see FIG. 6*b*). At the end of this pulse, an output pulse of the length $d_2$ is started by the second one-shot circuit 52 (see FIG. 6*c*). During the delay time $d_2$, the output 7' of the second one-shot circuit 52 will reset the first sample-and-hold circuit 55. At the end of this output pulse, that is at the point of time $t_1$, the operation of the third one-shot circuit 53 will be started.

Beginning at the point of time $t_1$, the output 9' of the third one-shot circuit 53 issues an output pulse having the length $d_3$ (see FIG. 6*d*). This pulse causes the first sample-and-hold circuit 55 to sample for a time period $d_3$ (first sampling period) and at the same time resets the second sample-and-hold circuit 56. At the end of the pulse at the point of time $t_2$, sampling and resetting is stopped, and the operation of the fourth one-shot circuit 54 will begin.

Beginning in the point of time $t_2$, the fourth one-shot circuit 54 delivers an output pulse of the length $d_4$ (see FIG. 6*e*), which is terminated at the point of time $t_3$. This output pulse causes the second sample-and-hold circuit 56 to sample, for a time period $d_4$ (second sampling period). The second sampling period $(t_3-t_2)=d_4$ is chosen to be close to the middle section of the beam current pulse (see FIG. 6*f*).

The output signals of the sample-and-hold circuits 55 and 56, representing different sections or portions of the same current pulse, are compared with each other in the differential amplifier 58. If both input signals of the comparator 58 are equal to each other, then the output signal a of the comparator 58 will be zero. This indicates that wave form I prevails, and that no adjustment is necessary. However, if the input signal from the first sample-and-hold circuit 55 is more positive than the input signal from the second sample-and-hold circuit 56, then the adjusting signal a will be negative. This indicates that there is too much HF power, and the negative adjusting signal a is used to reduce the HF power of the HF source 6. Conversely, if the input signal from the first sample-and-hold circuit 55 is more negative than the input signal from the second sample-and-hold circuit 56, then the adjusting signal a will be used to increase the HF power of the HF source 6.

While the form of the linear accelerator herein described constitutes a preferred embodiment of the invention, it is to be understood that the invention is not limited to this precise form of assembly and that a variety of changes may be made therein without departing from the scope of the invention.

What is claimed is:

1. A particle accelerator comprising:

(a) accelerator guide means for accelerating particles, said guide means having an input for receiving particles and an output for emitting pulses of high energy particles;

(b) injection means for injecting particles into the input of said guide means;

(c) a pulsed source of high frequency power, said source having power adjusting means;

(d) means for introducing said high frequency power from said source into said guide means for energy exchange with and for acceleration of said particles to obtain said high energy particle pulses at the output of said accelerator guide means;

(e) a magnet structure positioned at the output of said accelerator guide means for bending the path of said particles and for forming a beam of said particles passing therethrough, thereby acting as an energy filter for said particles;

(f) means for measuring said beam of particle pulses emitted from said magnet structure;

(g) high frequency power control means connected to said power adjusting means, said high frequency power control means including:

(g1) means for determining the pulse form of said particle pulses and for supplying an adjusting signal in dependence on the deviation of each particle pulse form from an optimum pulse form, said signal supplying means being connected to said measuring means; and (g2) means for connecting said adjusting signal means to said power adjusting means to change the high frequency power of said source, thereby adjusting the form of the measured particle pulses towards the optimum pulse form and maintaining a constant energy distribution in said beam of accelerated particles.

2. The particle accelerator of claim 1, wherein said means for measuring particle pulses is adapted to measure current pulses of said high energy particles.

3. The particle accelerator of claim 2, wherein said means for measuring current pulses includes a high energy particle target and a resistor connected to said target.

4. The particle accelerator of claim 1, wherein said particles are electrons and said particle accelerator is a linear accelerator.

5. The particle accelerator of claim 1, wherein means are provided to derive said optimum wave form from the actual wave form of each of the measured particle pulses.

6. The particle accelerator of claim 2, wherein said means for determining the pulse form of said particle pulses and for supplying said adjusting signal include:

(a) first determining means for determining the amplitude of a first section of each of said current pulses;

(b) second determining means for determining the amplitude of a consecutive second section of the same current pulse; and (c) comparing means connected to said first and second determining means for determining whether the amplitude of said second section is larger than the amplitude of said first section and for delivering said adjusting signal in dependence on such determination.

7. The particle accelerator according to claim 6, wherein pulses of said high frequency source are started by a trigger signal, and wherein said first and second means for determining the amplitude comprise first and second sample-and-hold circuits which are controlled in dependence on said trigger signal.

8. The particle accelerator according to claim 7, wherein the sampling time of said first sample and hold circuit is equal to the sampling time of said second sample and hold circuit.

9. The particle accelerator according to claim 8, wherein each sampling time is approximately $\frac{1}{3}$ of the pulse time of said pulsed source of high frequency.

10. The particle accelerator according to claim 7, wherein signal means are provided to stop sampling of said first sample-and-hold circuit when said second sample-and-hold-circuit is started.

11. The particle accelerator according to claim 7, wherein said sample-and-hold circuits are controlled by one-shot trigger circuits.

12. The particle accelerator according to claim 1, wherein said source is a klystron having a current control input and wherein said power adjusting means is said current control input.

* * * * *